US005836748A

United States Patent [19]

Kawaguchi et al.

[11] Patent Number: 5,836,748

[45] **Date of Patent: *Nov. 17, 1998**

[54] SWASH PLATE TYPE VARIABLE DISPLACEMENT COMPRESSOR UTILIZING A SPOOL FOR CONTROLLING THE INCLINATION

[75] Inventors: Masahiro Kawaguchi; Masanori Sonobe; Shigeki Kanzaki; Tomohiko Yokono; Ken Suitou, all of Kariya, Japan

[73] Assignee: Kabushiki Kaisha Toyoda Jidoshokki Seisakusho, Kariya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 615,239

[22] PCT Filed: Jul. 13, 1994

[86] PCT No.: PCT/JP94/01148

§ 371 Date: Mar. 12, 1996

§ 102(e) Date: Mar. 12, 1996

[87] PCT Pub. No.: WO96/02751

PCT Pub. Date: Feb. 1, 1996

[51] Int. Cl.[6] ..... F04B 1/29

[52] U.S. Cl. ..... 417/222.2; 417/269

[58] Field of Search ..... 417/222.1, 269, 417/222.2, 270, 272, 199.1, 218

[56] References Cited

U.S. PATENT DOCUMENTS

| | | | |
|---|---|---|---|
| 3,873,240 | 3/1975 | Leduc et al. | 417/270 |
| 4,621,983 | 11/1986 | Thomas et al. | 417/270 |
| 5,009,574 | 4/1991 | Ikeda et al. | 417/222 |
| 5,026,316 | 6/1991 | Kurosawa et al. | 417/222.2 |
| 5,316,446 | 5/1994 | Kimura et al. | 417/222.1 |
| 5,498,140 | 3/1996 | Kawaguchi et al. | 417/199.1 |
| 5,529,461 | 6/1996 | Kawaguchi et al. | 417/222.2 |
| 5,577,894 | 11/1996 | Kawaguchi et al. | 417/222.2 |
| 5,586,870 | 12/1996 | Kawaguchi et al. | 417/222.2 |
| 5,624,240 | 4/1997 | Kawaguchi et al. | 417/222.2 |

FOREIGN PATENT DOCUMENTS

| | | | |
|---|---|---|---|
| 0628722 A | 7/1994 | European Pat. Off. . | |
| 97805 | 5/1978 | Germany | 417/199.1 |
| 3215997 | 11/1982 | Germany . | |
| 3821834 | 1/1989 | Germany . | |
| 3900234 | 7/1989 | Germany . | |
| 40 33 422A1 | 4/1992 | Germany . | |
| 4311688 | 10/1993 | Germany . | |
| 4326519 | 3/1994 | Germany . | |

*Primary Examiner*—Timothy Thorpe
*Assistant Examiner*—Ted Kim
*Attorney, Agent, or Firm*—Brooks Haidt Haffner & Delahunty

[57] ABSTRACT

A housing has a crank chamber and a plurality of cylinder bores. The housing also has a discharge chamber and a suction chamber, which are communicatable with the cylinder bores. A drive shaft is supported in the housing, and pistons are accommodated in the respective cylinder bores. A swash plate is supported on the drive shaft in such a manner that its inclined angle can be altered, so that the undulation of the swash plate causes the pistons to reciprocate. When this compressor is running with the swash plate set upright, a controller activates an electromagnetic solenoid to supply a lubricating oil to a pressure chamber from an oil-supplying pump. This causes the spool to shift to temporarily hold the swash plate to an inclined position from the upright position.

20 Claims, 9 Drawing Sheets

SWASH PLATE TYPE VARIABLE DISPLACEMENT COMPRESSOR UTILIZING A SPOOL FOR CONTROLLING THE INCLINATION

This application is a 371 of PCT/JP94/01148 filed Jul. 13, 1994.

BACKGROUND OF THE INVENTION

1. Field of the Invention

The present invention relates to a swash plate type variable displacement compressor which is used in, for example, an air conditioning system for a vehicle.

2. Description of the Related Art

In general, an electromagnetic clutch is used to connect and disconnect the power transmission path from the engine to a compressor in a refrigerant circuit installed in a car. When an air conditioning system is switched on, the electromagnetic clutch is activated and engine power is transmitted to the compressor via a belt transmission mechanism and the electromagnetic clutch.

Frequent repetition of the connection and disconnection of the electromagnetic clutch to the compressor reduces the durability of the compressor, and also causes the entire refrigerant circuit to instantaneously vibrate when the compressor is activated.

In addition, whenever an electromagnetic clutch is used, the overall size and weight of a compressor is inevitably increased. This requires increased space to mount the compressor in the engine compartment and makes the mounting of the compressor difficult. Further, because the electromagnetic clutch when in action consumes considerable power, the battery in the vehicle must bear a great load.

As a solution to this shortcoming, a clutchless compressor has been proposed whose drive shaft is normally rotated with the engine. While the refrigerant gas is circulating between the compressor and the external refrigerant circuit, therefore, no significant problem arises. When there is an insufficient amount of the gas discharged to the external refrigerant circuit from the compressor, however, the circulation of the gas is stopped, which may cause insufficient lubrication of the sliding portions in the compressor. A clutchless swash plate type compressor designed to overcome this problem is disclosed in Japanese Unexamined Patent Publication No. Hei 3-37378. In this compressor, when the discharge of the gas to the external refrigerant circuit including an evaporator from the compressor is unnecessary, the valve which is connected to the suction chamber is closed to reduce the pressure in the suction chamber and the control valve for the passage between the discharge chamber and the crank chamber is opened.

When the gas discharge is unnecessary, the swash plate of the disclosed compressor is moved to have the minimum inclined angle to minimize the piston stroke. Further, the passage between the external refrigerant circuit and the compressor is blocked to suppress the load with respect to the rotation of the compressor. The slight reciprocation of each piston causes the gas to be discharged to the discharge chamber from the associated cylinder bore and to further flow into the crank chamber via the individual sliding portions from the discharge chamber. The gas in the crank chamber then flows to the suction chamber from which it is drawn into the associated cylinder bore.

According to the conventional compressor, as is apparent from the above, when the discharge of the gas to the external refrigerant circuit from the compressor is unnecessary, a small amount of refrigerant gas is circulated inside the compressor so that oil suspended in the refrigerant gas lubricates the sliding portions. As the gas in the compressor simply circulates, the amount of gas to be circulated is not enough to provide a sufficient amount of lubricating oil, causing insufficient or inadequate lubrication of the individual sliding portions, particularly, in the crank chamber.

Under low temperature conditions as in the winter or the like, when the compressor is stopped during large displacement operation, a large amount of gas remains, liquefied in the crank chamber. With this liquid refrigerant present, even when the compressor is activated, it is difficult to turn the liquid refrigerant to the gaseous state merely by the gas circulation in the compressor which is running now with a small displacement. When the liquid refrigerant is circulated in the compressor, therefore, the oil sticking on the individual sliding portions is washed out. This deteriorates the lubrication in the compressor and increases the power loss.

SUMMARY OF THE INVENTION

Accordingly, it is a primary objective of the present invention to provide a clutchless swash plate variable displacement compressor, which will overcome the aforementioned conventional shortcomings and can improve the lubrication performance at the individual sliding portions in the compressor.

A housing having a crank chamber and a plurality of cylinder bores also has a discharge chamber and a suction chamber, which are communicatable with the cylinder bores. A drive shaft is supported in the housing, and pistons are accommodated in the respective cylinder bores. A swash plate is supported on the drive shaft in the crank chamber in such a manner that its inclined angle is changeable, so that the undulation of the swash plate causes the pistons to reciprocate. The compressor further comprises a mechanism for temporarily holding the swash plate to an inclined position from an upright position when the compressor is running when the swash plate would otherwise be caused to stay upright.

With this structure, it is possible to lubricate components inside the compressor without intercepting the passage between the compressor and the external refrigerant circuit when the compressor is running with the zero displacement or a small displacement close to zero.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

First Embodiment

A preferred embodiment of the present invention will now be described referring to the accompanying drawings.

Figure 2:
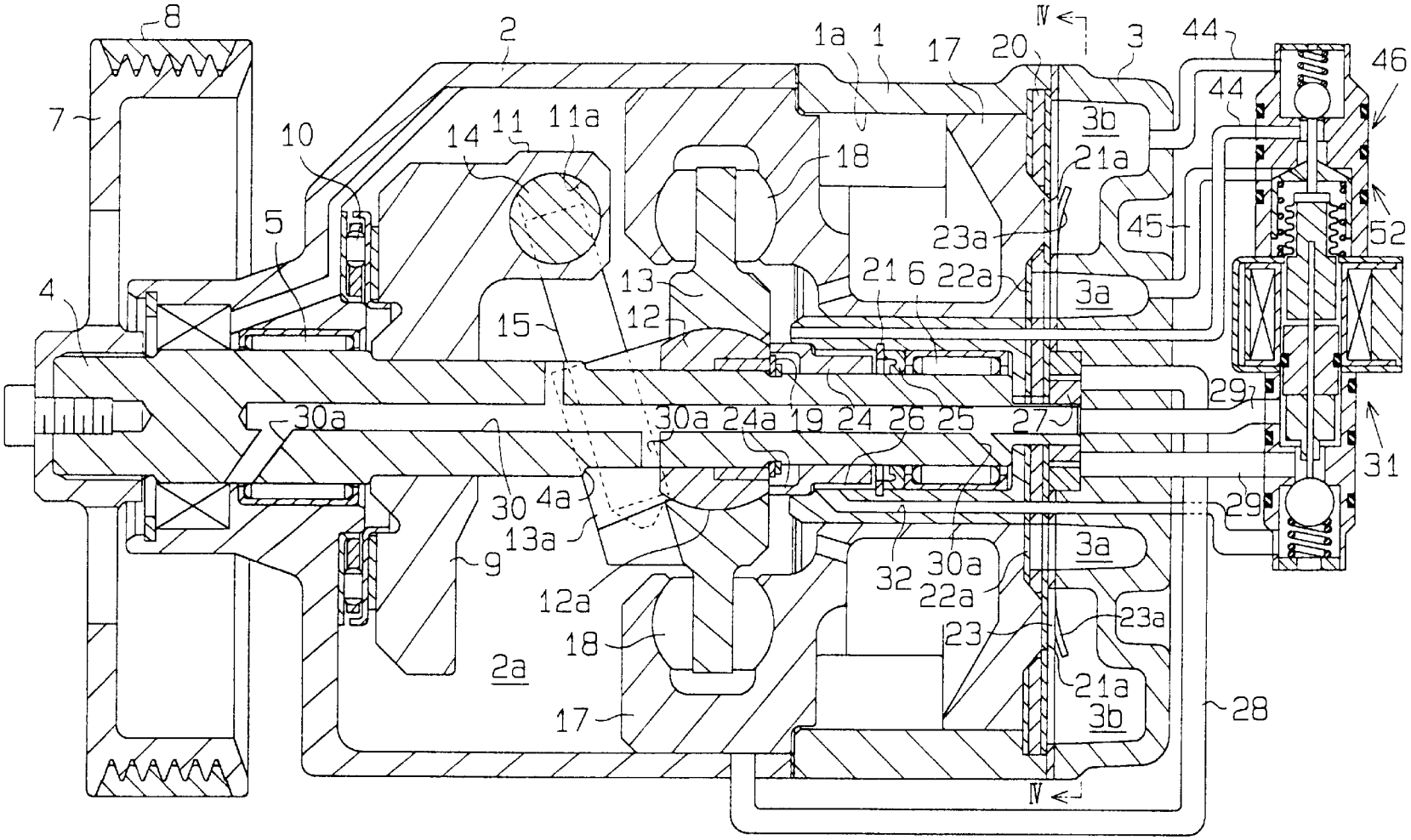
FIG. 2 is a vertical cross-sectional view showing the overall compressor under zero-displacement conditions.

As illustrated in FIG. 2, a front housing 2 is fixed to a cylinder block 1. A crank chamber 2*a* is formed in the front housing 2. A plurality of cylinder bores 1*a* are formed in the cylinder block 1. A rear housing 3 is secured to the cylinder block 1. A suction chamber 3*a* and a discharge chamber 3*b* are defined in the rear housing 3. The front housing 2, cylinder block 1 and rear housing 3 constitute the housing of a compressor.

A drive shaft 4 is rotatably supported in the cylinder block 1 and front housing 2 via radial bearings 5 and 6 in such a manner that the drive shaft 4 passes through the crank chamber 2*a*. A pulley 7 is secured to the free end portion of the drive shaft 4 outside the compressor. A belt 8 is wrapped around the pulley 7, so that the rotation of the engine is transmitted via the belt 8 and pulley 7 to the drive shaft 4.

A rotary plate 9 is secured to the drive shaft 4 inside the crank chamber 2*a*. A thrust bearing 10 is arranged on the inner wall of the front housing 2 to receive the thrust load applied to the rotary plate 9. A support arm 11, having a hole 11*a*, is integrally formed with the rotary plate 9.

A swash plate support 12 having a spherical surface 12*a* is reciprocatably supported on the drive shaft 4 along its axial direction. A swash plate 13 is supported on the swash plate support 12 to be tiltable along the spherical surface 12*a*.

Figure 3:
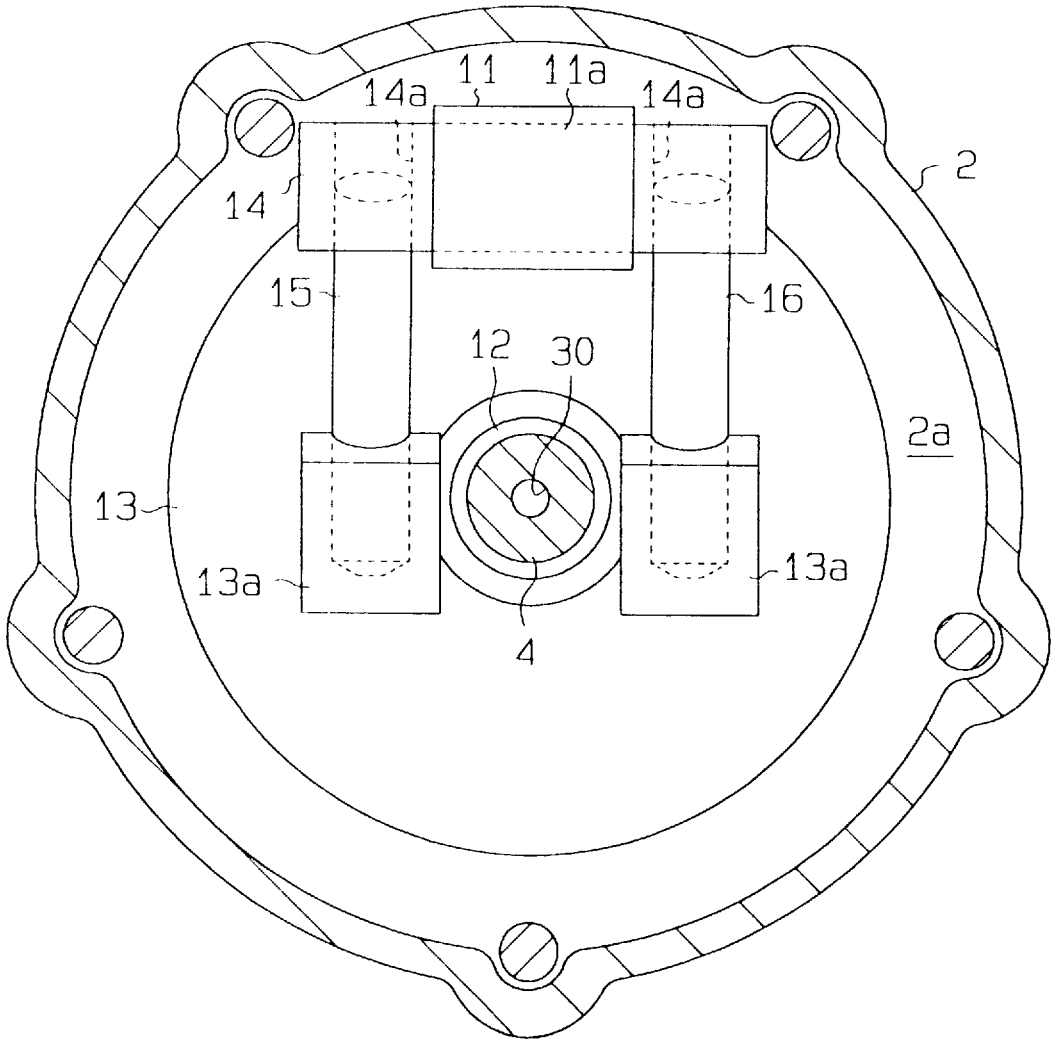
FIG. 3 is a horizontal cross-sectional view showing a hinge mechanism.

A support pin 14 is fitted in the hole 11*a* of the support arm 11 so as to be rotatable about its own axis, with guide holes 14*a* formed in both end portions of the support pin 14, respectively. See FIG. 3. Two parallel projections 13*a* are integrally formed at the center portion of the swash plate 13 in such a position to sandwich the drive shaft 4. A pair of guide pins 15 and 16 are respectively fixed to the two parallel projections 13*a*, and have their free end portions slidably fitted in the guide holes 14*a*. In this embodiment, the support arm 11, the swash plate support 12, the guide pins 15 and 16 and the projections 13*a* allow the swash plate 13 and the rotary plate 9 to rotate together. Together, these components form a hinge mechanism that permits the variable inclination of the swash plate 13.

As shown in FIG. 2, a plurality of pistons 17 are reciprocatably placed in the respective cylinder bores 1*a*. A pair of shoes 18 are supported by each piston 17. The peripheral portion of the swash plate 13 is positioned between the individual shoes 18 of each pair. The undulating rotation of the inclined swash plate 13 causes the pistons 17 to reciprocate. A stopper 19 is secured to the outer surface of the drive shaft 4. When the swash plate support 12 abuts on the stopper 19, the swash plate 13 is held upright. A step 4*a* is formed on the outer surface of the drive shaft 4 to determine the maximum inclined angle at which the swash plate 13 can be positioned.

Figure 1:
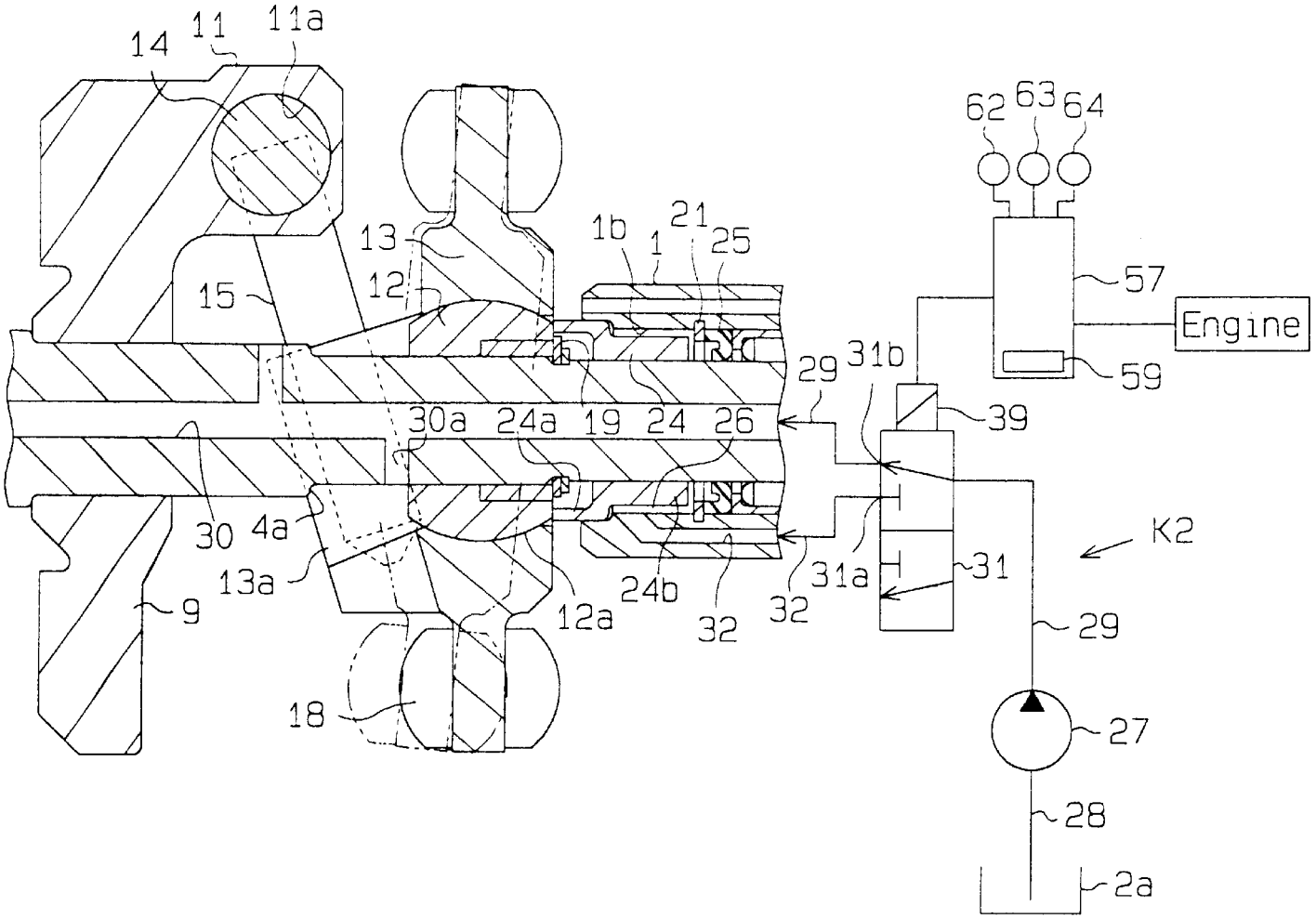
FIG. 1 is a vertical cross-sectional view of essential portions of a swash plate type variable displacement compressor according to one embodiment of the present invention.
Figure 4:
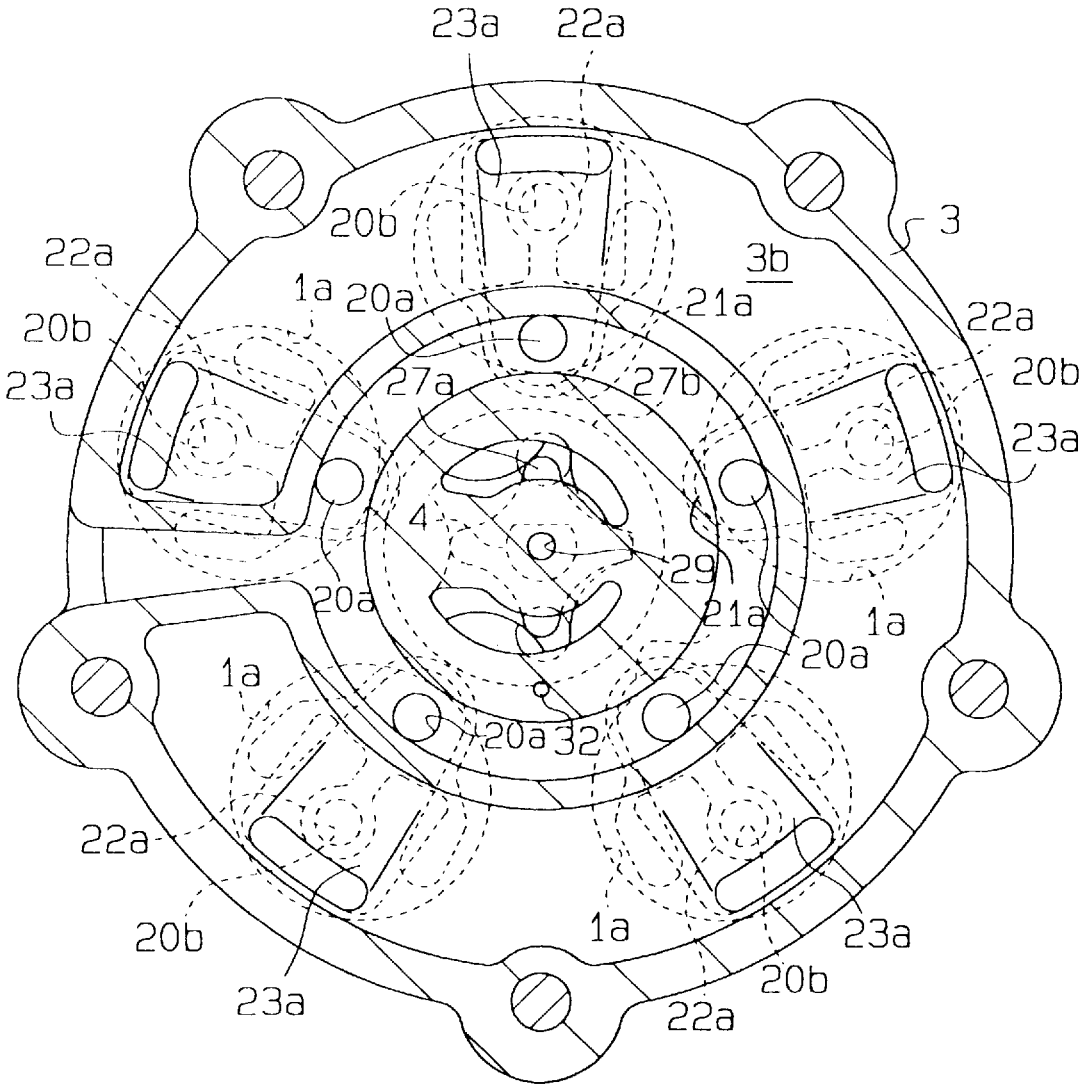
FIG. 4 is a cross-sectional view taken along the line IV—IV in FIG. 2.

A valve plate 20 is secured between the cylinder block 1 and the rear housing 3. As best seen in FIG. 4, a suction hole 20*a* and a discharge hole 20*b* are formed in the valve plate 20 in association with each cylinder bore 1*a*. A discharge valve 21*a* and a suction valve 22*a* are formed in the valve plate 20, and are of the reed valve type. A retainer plate 23 (see FIG. 2) is placed over the valve plate 20. A retainer 23*a* is formed on the retainer plate 23 in association with each discharge valve 21*a* to prevent that discharge valve 21*a* from opening too much. As shown in FIG. 1, a center hole 1*b* is formed in the cylinder block 1. A cylindrical spool 24 is slidably supported on the outer surface of the drive shaft 4 in the center hole 1*b*. A lip seal 25 is provided on the inner surface of the center hole 1*b* between the radial bearing 6 (see FIG. 2) and the spool 24. A ring 21 is secured to the inner surface of the center hole 1*b* to hold the lip seal 25 in place.

The spool 24 has a large-diameter portion 24*a* and a small-diameter portion 24*b*. When the spool 24 is in a retracted position as shown in solid lines in FIG. 1, the outer surface of the large-diameter portion 24*a* contacts the inner surface of the center hole 1*b*. A pressure chamber 26 is formed between the outer surface of the small-diameter portion 24*b* of the spool 24 and the inner surface of the center hole 1*b*.

When oil is supplied to the pressure chamber 26 with the large-diameter portion 24*a* in contact with the inner surface of the center hole 1*b*, the spool 24 is urged along to the drive shaft 4 and moved forward in the direction of the swash plate support 12. As a result, the swash plate support 12 moves in the same direction. This causes the swash plate 13 to move from the upright position to the inclined position shown in phantom lines in FIG. 1.

Figure 5:
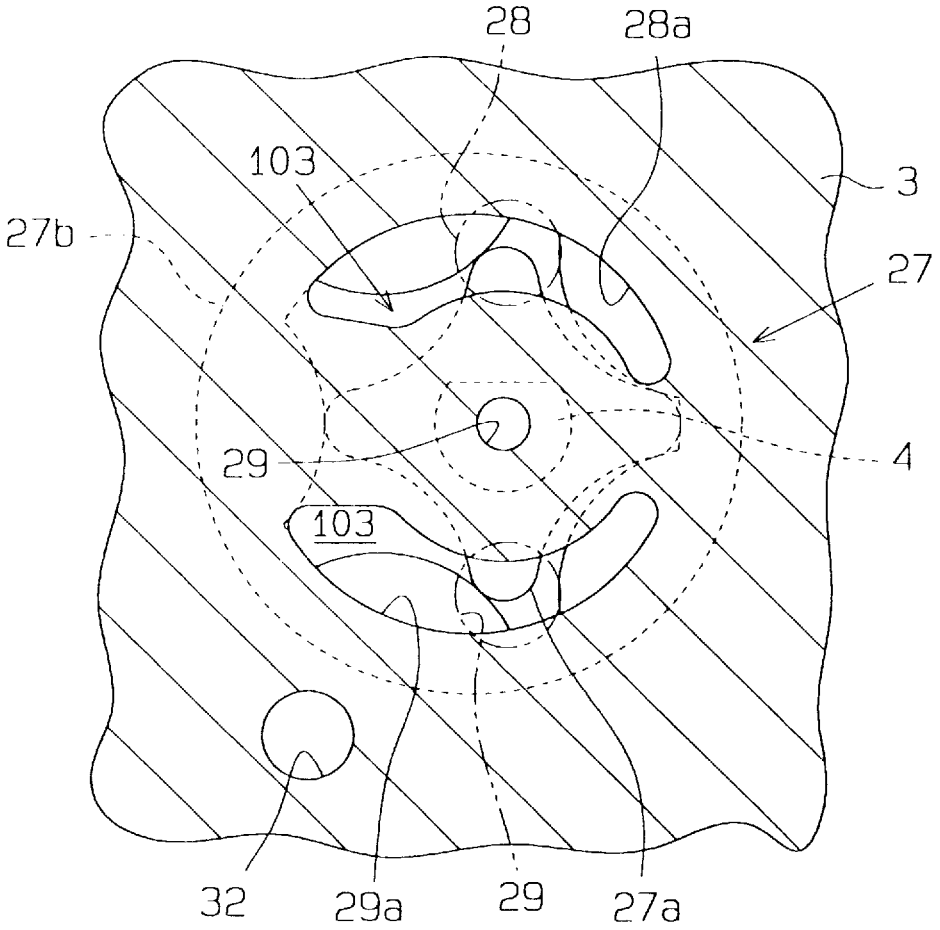
FIG. 5 is a cross-sectional view showing an oil pump.

As shown in FIGS. 2 and 5, a trochoid pump 27 is located at the center of the rear housing 3. As shown in FIG. 5, this pump 27 has inner teeth 27*a* and outer teeth 27*b*. The inner teeth 27*a* are rotated by the drive shaft 4. As the inner teeth 27*a* rotate, the outer teeth 27*b* rotate in the same direction at a slower speed than the inner teeth 27*a*.

As shown in FIG. 5, a clearance 103 formed between the teeth 27*a* and 27*b*, shifts in the rotational direction of the teeth 27*a* and 27*b*. During this shift, the clearance undergoes a change in its volume due to the difference between the rotational speeds of the teeth 27*a* and 27*b*. Through the above-described action, the lubricating oil is led into the clearance 103 from an arcuate suction port 28*a* and is discharged through an arcuate discharge port 29*a*.

A first oil passage 30 is formed axially in the center of the drive shaft 4, as shown in FIG. 2. Branch oil passages are formed at a plurality of points of the first oil passage 30 allowing oil to be supplied to the bearings 5 and 6, the crank chamber 2*a*, the swash plate support 12, etc. A second oil passage 28 is connected between the bottom of the crank chamber 2*a* and the suction port 28*a* of the pump 27. A third oil passage 29 is connected between the discharge port 29*a* of the pump 27 and the first oil passage 30. As shown in FIGS. 1 and 2, a first valve assembly 31 is provided in the third oil passage 29. This first valve assembly 31 is connected via a fourth oil passage 32 to the pressure chamber 26.

Figure 6:
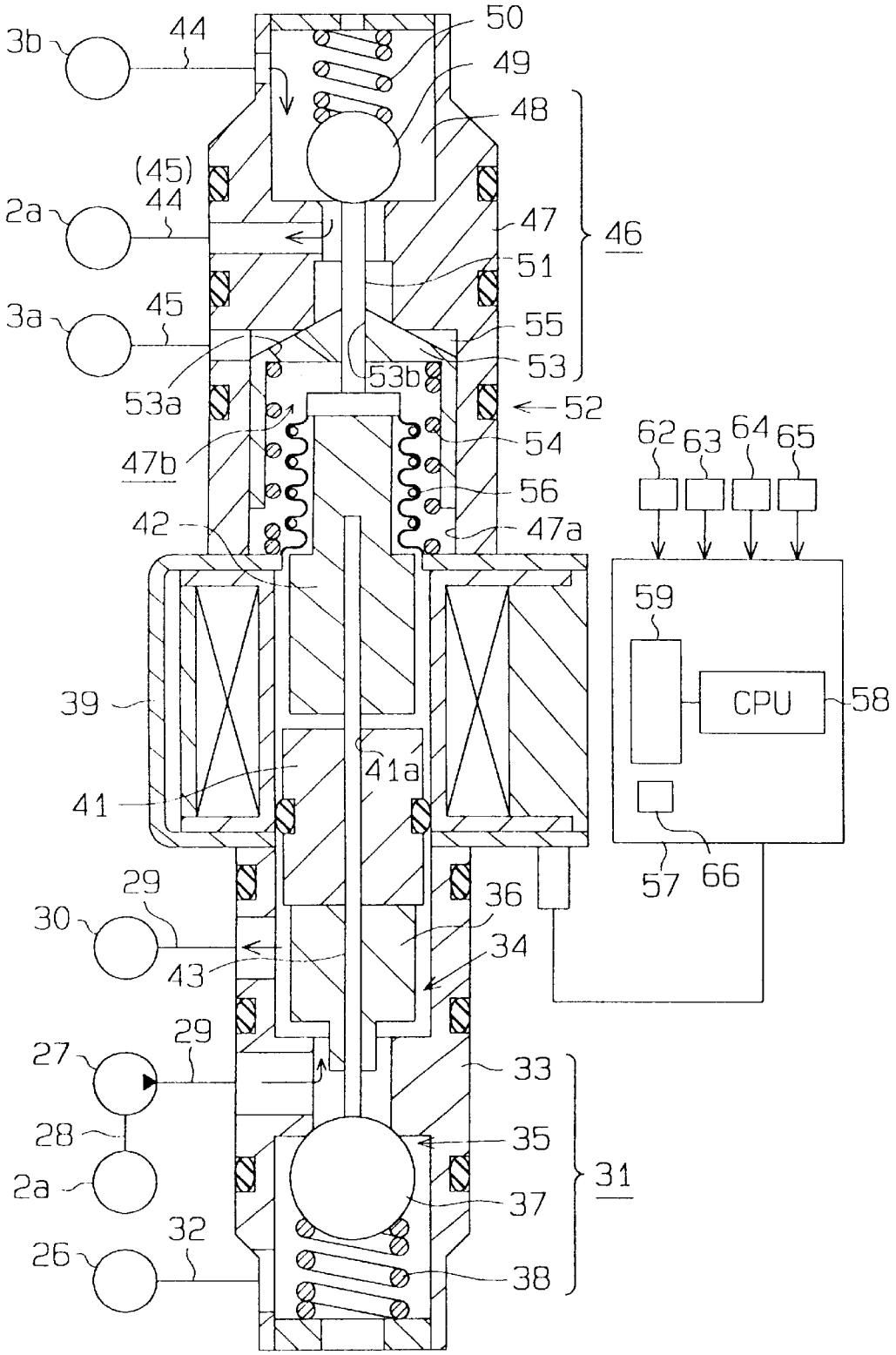
FIG. 6 is a vertical cross-sectional view showing an electromagnetic direction switching valve, an electromagnetic open/close valve and a pressure control valve.

As shown in FIG. 6, first and second valve chambers 34 and 35 are formed in a valve case 33. A columnar shaped first valve 36 and a spherical shaped second valve 37 are respectively disposed in the valve chambers 34 and 35. The second valve 37 is urged by a spring 38 in a direction to close the fourth oil passage 32.

An electromagnetic solenoid 39 is secured on the top of the case 33, and a fixed core 41 and a movable core 42 are retained in the solenoid 39. A hole 41*a* is formed in the fixed core 41, with a first rod 43 inserted in the hole 41*a* in a lengthwise direction. The first rod 43 has a first end portion fixed to the movable core 42 and a second end portion abutting on the second valve 37. The first valve 36 is secured to the second end portion of the first rod 43.

As shown in FIG. 6, with the solenoid 39 de-excited, the movable core 42 is separated from the fixed core 41 by the urging force of the spring 38. This allows the second valve 37 to be held at the position to close the fourth oil passage 32 and for the first valve 36 to be held at the position in order to open the third oil passage 29. The oil is supplied to the passage 30 of the drive shaft 4 from the passage 29 to lubricate the individual sliding portions in the compressor as shown in FIG. 1.

Figure 7:
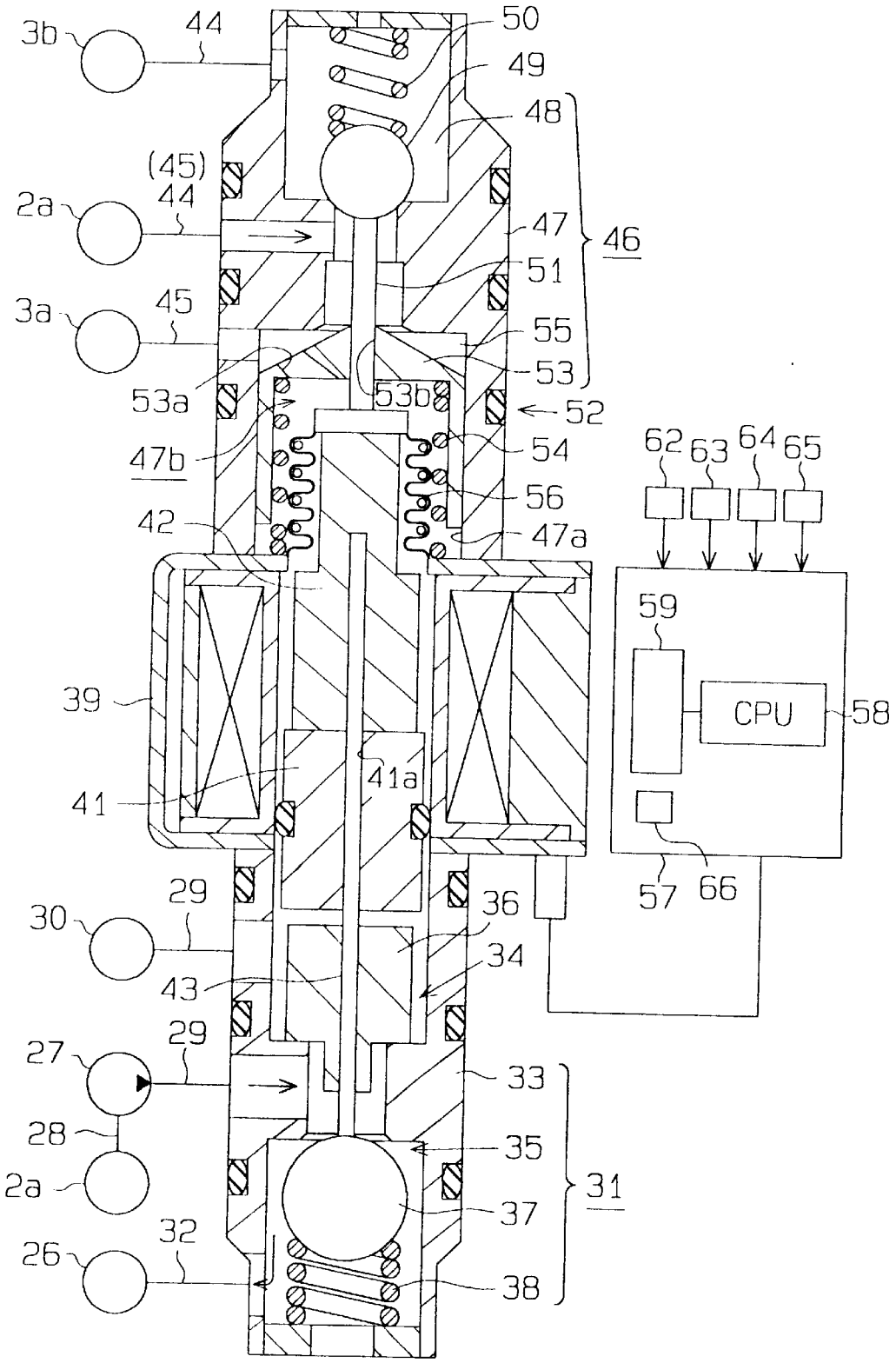
FIG. 7 is a vertical cross-sectional view also showing the electromagnetic direction switching valve, the electromagnetic open/close valve and the pressure control valve.

With the solenoid 39 excited, as shown in FIG. 7, the movable core 42 is attracted to the fixed core 41 against the urging force of the spring 38. This permits the first valve 36 to be shifted to the position to close the third oil passage 29. At the same time, the second valve 37 is shifted to the position to open the fourth oil passage 32. The oil provided from the pump 27 is not supplied to the first oil passage 30, but is supplied into the pressure chamber 26 via the fourth oil passage 32. The spool 24 therefore moves forward to shift the swash plate support 12 in the same direction. This causes the swash plate 13 to move to the inclined position from the upright position.

As shown in FIG. 2, a first gas passage 44 is connected between the discharge chamber 3*b* and the crank chamber 2*a*. A second gas passage 45 is connected to the suction chamber 3*a* and the crank chamber 2*a*. As shown in FIG. 6, the first gas passage 44 and the second gas passage 45 are in partial communication with each other. A second valve assembly 46 is provided midway in the first gas passage 44. Both the first and second valve assemblies 31 and 46 utilize the electromagnetic solenoid 39.

As shown in FIG. 6, a valve chamber 48 is formed in a valve case 47 of the second valve assembly 46. A spherical valve 49 is disposed in the valve chamber 48. A spring 50 urges the valve 49 to close the passage 44. A second rod 51 is fixed to the movable core 42 and abuts on the valve 49.

With the solenoid 39 excited, as shown in FIG. 7, the second rod 51 moves, together with the movable core 42, away from the valve 49. Concurrently, spring 50 urges the valve 49 to close the passage 44.

Figure 8:
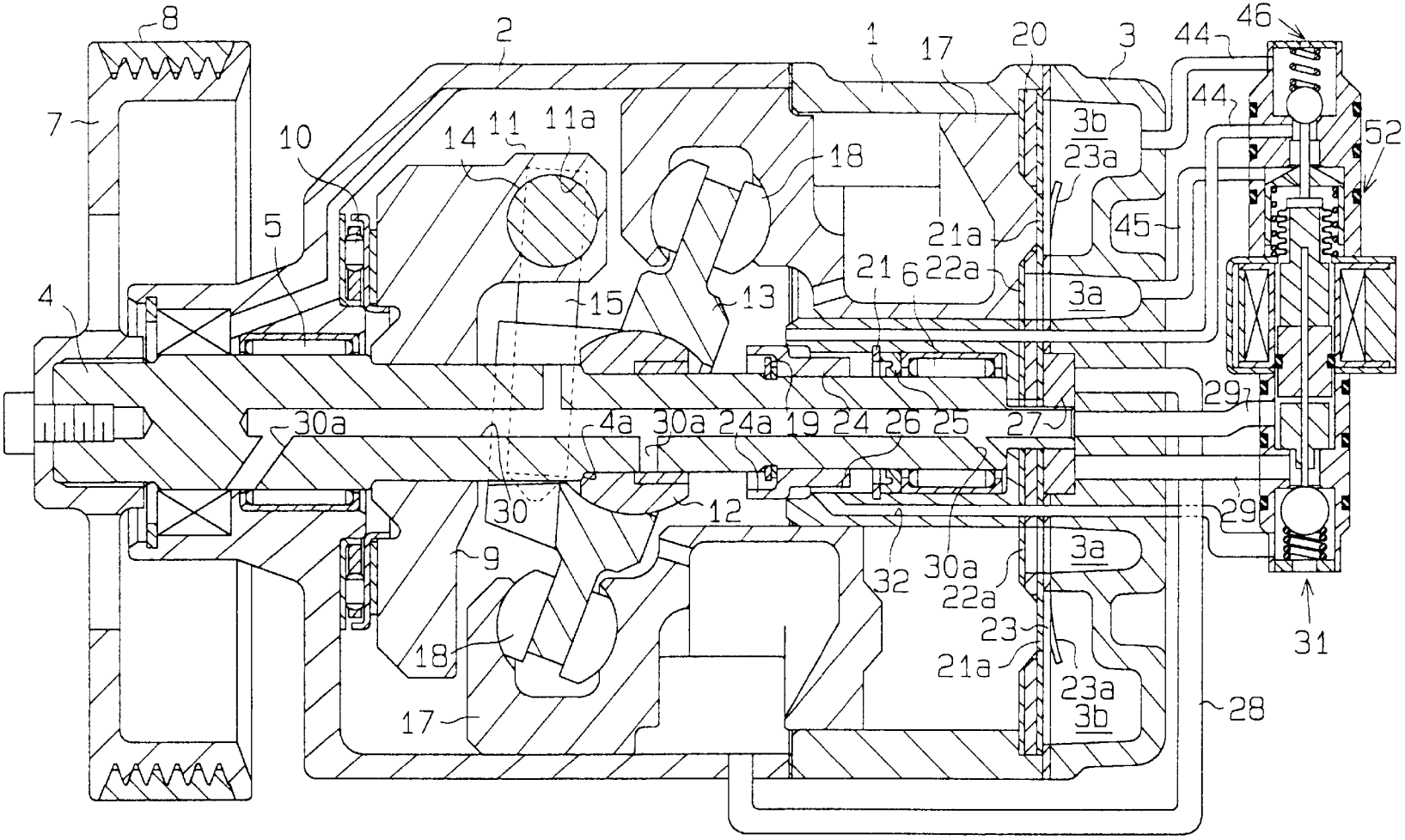
FIG. 8 is a vertical cross-sectional view showing the overall compressor with a large displacement.

When the solenoid 39 is de-excited during a compression cycle with the swash plate 13 inclined, the second rod 51, as shown in FIG. 6, is moved upward by the urging force of the spring 38 via the second valve 37, the first rod 43 and the movable core 42. This configuration is also shown in FIG. 8. Accordingly, the valve 49 is shifted to the position to open the passage 44. Consequently, the high-pressure gas is supplied via the passage 44 to the crank chamber 2*a* from the discharge chamber 3*b*, thus increasing the differential pressure $\Delta p$ between the pressure in the crank chamber 2*a* and the pressure in the suction chamber 3*a*, which acts on each piston 17. The swash plate 13 is therefore forced to move to the upright position from the inclined position.

During the compressor's compression cycle, the displacement altering control is performed on the compressor in accordance with the cooling load. In accordance with the value of the suction pressure proportional to the cooling load, the degree of the opening of the passage 45, which is connected to the crank chamber 2*a* and suction chamber 3*a*, is adjusted. As a result, an adjustment is made to the differential pressure $\Delta p$ acting on the piston 17.

As shown in FIG. 6, a third valve assembly 52 is located between the first and second valve assemblies 31 and 46. A retainer chamber 47*a* is formed in the case 47. A valve 53 is disposed in the retainer chamber 47*a* to open or close the passage 45. This valve 53 is urged by a spring 54 in a direction to close the passage 45. A chamber 55 is defined by the valve 53 and the case 47. The suction pressure in the suction chamber 3*a* is applied inside the chamber 55 via the passage 45. A chamber 75, formed in the case 47, communicates with the crank chamber 2*a*.

The degree of opening of the passage 45 is controlled based on the difference between the pressure in the chamber 55 and that in the chamber 75. This chamber 55 communicates with a chamber 47*b*, defined between the inner surface of the valve 53 and a bellows 56, via a passage 53*a* formed in the valve 53. The second rod 51 is slidably inserted through a hole 53*b* formed in the valve 53.

With a large cooling load and a high pressure in the suction chamber 3*a*, a large pressure is created in the chamber 55 causing the valve 53 to open. Therefore, a large amount of gas flow into the suction chamber 3*a* via the passage 45 from the crank chamber 2*a*. As a result, the differential pressure p acting on the piston 17 decreases, causing the inclined angle of the swash plate 13 to increase. This in turn results in an increase in the stroke of the piston 17 as well as in an increase in the compressor's displacement.

When the cooling load becomes smaller and the pressure in the suction chamber 3*a* falls, on the other hand, the pressure in the chamber 55 also drops. Accordingly, the valve 53 is shifted in a direction that restricts the passage 45. This increases the differential pressure p which in turn reduces the inclined angle of the swash plate 13 and the stroke of the piston 17. The compressor can thus operate with a small displacement.

A passage provided between the crank chamber 2*a* and the suction chamber 3*a* includes a restriction (not shown). Accordingly, blow-by gas entering the crank chamber 2*a*, passing between the inner surface of each cylinder bore 1*a* and the associated piston 17, circulates back to the suction chamber 3*a*.

As shown in FIG. 6, a controller 57 as control means, electrically connected to the coil 40, of the electromagnetic solenoid 39, comprises a central processing unit (CPU) 58 and a timer 59. The controller 57 receives various electrical signals from an ignition switch 62 for the engine, an air conditioning switch 63, a sensor 64 for detecting the temperature of the gas discharged from the compressor, a sensor 65 for detecting the temperature inside the vehicle, a suction pressure sensor (not shown), a discharge pressure sensor (not shown), and the like. The timer 59 executes a counting operation to set the operation start timing and the operation time for the electromagnetic solenoid 39. When the air conditioning switch 63 is switched on, the electromagnetic solenoid 39 is energized.

The CPU 58 has a memory 66 which stores various kinds of data.

The operation of the thus constituted variable displacement compressor will be now described.

When the engine starts while the air conditioning switch 63 is switched off, the drive shaft 4 of the compressor rotates. The ON signal from the engine ignition switch 62 is transferred to the controller 57, causing the electromagnetic solenoid 39 to be excited for a predetermined time, e.g., 10 minutes. This time is set by the timer 59, under the control of the CPU 58.

Consequently, as shown in FIG. 7, the movable core 42 is attracted to the fixed core 41, so that the first valve 36 is positioned to close the third oil passage 29, and the second valve 37 is positioned to open the fourth oil passage 32.

Therefore, the pump 27 supplies the oil to the pressure chamber 26 via the fourth oil passage 32.

As a result, the spool 24 moves forward, shifting the swash plate 13 forward to the inclined position indicated by the chain line in FIG. 1 from the upright position indicated by the solid line in this diagram. The spool 24 moves forward until it hits against the stopper 19. At this time, the large-diameter portion 24*a* comes off the center hole 1*b*, permitting the oil in the pressure chamber 26 to flow into the crank chamber 2*a*. As indicated by the chain line in FIG. 1, the inclined angle of the swash plate 13 is not large.

As the drive shaft 4 rotates, the piston 17 reciprocates in the associated cylinder bore 1*a*, causing the gas to be supplied into the cylinder bore 1*a* from the external refrigerant circuit via the suction chamber 3*a*. The supplied gas is compressed in the cylinder bore 1*a* and is then discharged to the external refrigerant circuit via the discharge chamber 3*b*. Because the inclined angle of the swash plate 13 is not large at this time, the compressor will run with a small displacement.

The excited electromagnetic solenoid 39 moves the second rod 51 together with the movable core 42 downward in FIGS. 6 and 7. At the same time, the spring 50 urges the valve 49 of the second valve assembly 46 to a position to close the passage 44. Consequently, the gas supply to the crank chamber 2*a* from the discharge chamber 3*b* is stopped.

After the elapse of a predetermined time (e.g., about 10 minutes), the timer 59 de-excites the electromagnetic solenoid 39 upon time-up. Consequently, the first valve 36 of the first valve assembly 31 is urged in the direction that opens the third oil passage 29, while the second valve 37 is urged in the direction that closes the fourth oil passage 32 as shown in FIG. 6. This inhibits the oil supply to the pressure chamber 26, thereby freeing the spool 24.

The second rod 51 causes the valve 49 of the second valve assembly 46 to move in the direction to open the passage 44 against the urging force of the spring 50. This allows high-pressure gas to be supplied into the crank chamber 2*a* from the discharge chamber 3*b*, thus increasing the differential pressure Δp that acts on the piston 17. As a result, the swash plate 13 is forced to return to the upright position, causing the compressor to be switched to the zero-displacement operation mode.

Under the zero-displacement operation, the pressure in the discharge chamber 3*b* drops, reducing the differential pressure Δp. Since the center of gravity of the swash plate 13 lies opposite the hinge mechanism with respect to the drive shaft 4, the swash plate 13 is held at the upright position due to the centrifugal force acting on the gravitational center of the swash plate 13.

As described above, when the compressor is activated, the compressor temporarily runs with a small displacement, e.g., 10%. Therefore, the oil laden gases in the condenser and evaporator are supplied to the suction chamber 3*a*. The oil laden gas is also blown by to the crank chamber 2*a* from the compression chamber in the associated cylinder bore 1*a*, passing through the clearance between the outer surface of the associated piston 17 and the inner surface of the associated cylinder bore 1*a*.

The liquid refrigerant in the crank chamber 2*a*, together with that gas, flows via the passage 45 into the suction chamber 3*a* from which it is supplied into the cylinder bore 1*a*. The liquid refrigerant is then discharged from the cylinder bore 1*a*. Accordingly, the lubricating oil-containing liquid refrigerant in the crank chamber 2*a* is gradually gone. In the above-described manner, the gas circulates between the compressor and the external refrigerant circuit, so that the oil and gas in the external refrigerant circuit return to the compressor.

When the air conditioning switch 63 is switched on, the controller 57 keeps the electromagnetic solenoid 39 excited, permitting the continual supply of the lubricating oil to the pressure chamber 26 from the pump 27. The spool 24 is therefore held at the forward position. At this time, the swash plate 13 turns while its inclined angle is being adjusted in accordance with the cooling load. This reciprocates the piston 17 to execute the gas compression stroke.

During this operation, the degree of opening of the passage 45 is adjusted by the third valve assembly 52 in accordance with a change in the suction pressure that is proportional to the cooling load. Consequently, the differential pressure Δp acting on the piston 17 is adjusted. In accordance with the cooling load, therefore, the inclined angle of the swash plate 13 is altered to adjust the discharge displacement.

When the temperature inside the vehicle is low and the cooling load is small, the pressure in the suction chamber 3*a* is low so that the degree of opening of the passage 45 is reduced by the valve 53 of the third valve assembly 52. As a result, the differential pressure Δp acting on the piston 17 is kept large so that the swash plate 13 is held at the minimum inclined angle for the 10% displacement operation.

When the cooling load is large, on the other hand, the pressure in the suction chamber 3*a* is high so that the degree of opening of the passage 45 is increased by the valve 53 of the third valve assembly 52, thus reducing the differential pressureΔp. Consequently, the swash plate 13 is moved away from the spool 24 to the maximum inclination side. When the cooling load is large, generally speaking, the air conditioning switch 63 is switched on, so that the compressor runs with a large displacement upon the activation of the engine.

When the zero-displacement operation continues for a predetermined time, i.e., when the de-excitation state of the electromagnetic solenoid 39 continues for a given time (e.g., 10 to 30 minutes) after the air conditioning switch 63 is switched off, the swash plate 13 is temporarily inclined by the timer 59 to accomplish the operation under compression. In other words, the electromagnetic solenoid 39 is excited for a predetermined time, e.g., 10 minutes, set by the timer 59, under the control of the CPU 58.

Consequently, as mentioned earlier, the movable core 42 is attracted to the fixed core 41, so that the first valve 36 is positioned to close the third oil passage 29, and the second valve 37 is positioned to open the fourth oil passage 32. Therefore, the pump 27 supplies the oil to the pressure chamber 26 via the fourth oil passage 32.

As a result, the spool 24 moves forward, shifting the swash plate 13 to the inclined position indicated by the chain line in FIG. 1 from the upright position indicated by the solid line in this diagram. As the drive shaft 4 rotates, therefore, the gas circulates between the compressor and the external refrigerant circuit, ensuring rich lubrication inside the compressor.

When the predetermined time elapses, the timer 59 de-excites the electromagnetic solenoid 39 upon time-up. Consequently, the second rod 51 causes the valve 49 of the second valve assembly 46 to move in the direction to open the passage 44 against the urging force of the spring 50. High-pressure gas is therefore supplied into the crank chamber 2*a* from the discharge chamber 3*b*, thus increasing the differential pressure Δp that acts on the piston 17. As a result, the swash plate 13 is forced to return to the upright position, causing the compressor to be switched to the zero-displacement operation mode.

In short, when the compressor according to this embodiment is called upon to run in the zero-displacement mode when the air conditioning switch 63 is set off, the compressor is shifted to the small-displacement state every given period of time, allowing the gas to circulate between the compressor and the external refrigerant circuit. The sliding portions inside the compressor are therefore well lubricated. Because this periodic operation every given period of time is carried out with a small displacement, the load on the engine is small.

This invention is not limited to the above-described embodiment, but may be embodied in the following forms without departing from the spirit and scope of the invention.

Figure 9:
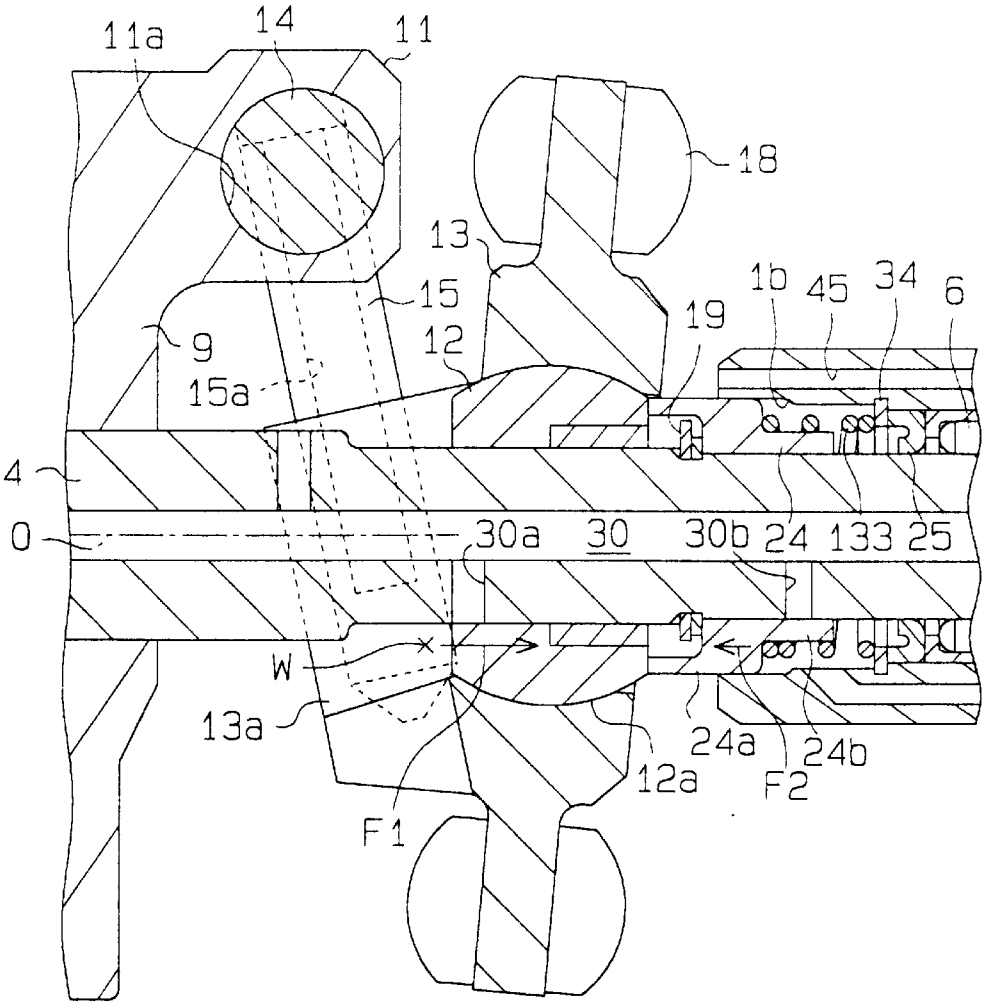
FIG. 9 is a vertical cross-sectional view showing another compressor according to this invention.

(1) A spring 133 may be disposed in the pressure chamber 26 to urge the spool 24 forward while the compressor is not running, as shown in FIG. 9.

With this structure, when the compressor is running, the inclined angle of the swash plate 13 is controlled as per the above-described embodiment. When the compressor is not running, the swash plate 13 is held at the minimum inclination position by the spring 133. When the engine is activated, therefore, the compressor spontaneously starts running with a small displacement, thus further improving the lubrication performance at the individual sliding portions in the crank chamber 2*a*.

(2) In the above-described embodiment, the valve 53 to open or close the second passage 45 is opened or closed in accordance with the suction pressure. Instead of the use of the suction pressure, an electromagnetic valve may be used so that the valve 53 is opened or closed by an externally supplied signal.

We claim:

1. A compressor having a drive shaft rotatably supported in a housing, a swash plate mounted on for rotation with said drive shaft, and a piston slidably accommodated in a cylinder bore, rotation of the swash plate with said drive shaft being converted to reciprocating movement of the piston in the cylinder bore to compress gas containing oil mist which, upon circulation within the compressor, lubricates component parts of said compressor in moving contact with each other, said swash plate being tiltable between an upright position normal to the drive shaft and a range of inclining positions with respect to the longitudinal axis of the drive shaft to increase displacement of the compressor, and wherein compressed gas is discharged from a discharge chamber, said compressor comprising:

means for forcibly operating the swash plate to incline the swash plate from the upright position when said swash plate would otherwise be caused to assume the upright position to thereby compress and circulate within the compressor gas containing oil mist, whereby the oil mist is supplied to said component parts.

2. The compressor as set forth in claim 1, wherein said means for forcibly operating the swash plate temporarily inclines the swash plate from the upright position when the compressor is driven.

3. The compressor as set forth in claim 2, wherein said means for forcibly operating the swash plate temporarily inclines the swash plate from the upright position starting with the moment the compressor commences to be driven.

4. The compressor as set forth in claim 1, further comprising:

a crank chamber defined in the housing and accommodating said swash plate; and means for inclining the swash plate throughout said range of inclining positions, which means includes a gas passage communicating between said discharge chamber and said crank chamber for supplying said discharged compressed gas to the crank chamber from the discharge chamber, and means for controlling the flow of compressed gas through said crank chamber whereby an inner pressure of the crank chamber is varied for changing the inclining position of the swash plate.

5. The compressor as set forth in claim 4, wherein said means for forcibly operating the swash plate includes a switchable electromagnetic valve connected to said gas passage.

6. The compressor as set forth in claim 1, wherein said housing includes a central hole accommodating a spool disposed for movement axially along a radially outer surface of the drive shaft;

said compressor includes a support member for supporting the swash plate, and said means for forcibly operating the swash plate includes means for moving the spool to engage said support member to drive said support member to incline the swash plate.

7. The compressor as set forth in claim 6, wherein said spool has a radially outer cylindrical surface;

said central hole has a radially inner cylindrical surface;

said compressor includes a pressure chamber defined between said cylindrical surfaces; and a hydraulic pump is connected to the pressure chamber, said pump being arranged to be actuated by the rotation of the drive shaft.

8. The compressor as set forth in claim 7, further comprising:

an oil passage extending in the drive shaft along the longitudinal axis of the drive shaft, said passage having openings for communicating with the component parts, wherein said hydraulic pump supplies the oil mist to the component parts by way of the oil passage.

9. The compressor as set forth in claim 8, further comprising a valve connecting the hydraulic pump with either the pressure chamber or the oil passage.

10. The compressor as set forth in claim 7, further comprising a spring accommodated in the pressure chamber to hold the swash plate at a minimum inclining position by means of the spool when the compressor is at a standstill.

11. A compressor having a drive shaft rotatably supported in a housing, a swash plate mounted on for rotation with said drive shaft, and a piston slidably accommodated in a cylinder bore, rotation of the swash plate with said drive shaft being converted to reciprocating movement of the piston in the cylinder bore to compress gas containing oil mist which, upon circulation within the compressor, lubricates component parts of said compressor in moving contact with each other, means for forcibly operating said swash plate to incline the swash plate between an upright position normal to the drive shaft and a range of inclining positions with respect to the longitudinal axis of the drive shaft to increase displacement of the compressor, and wherein compressed gas is discharged from a discharge chamber, said compressor comprising:

a crank chamber defined in the housing and accommodating said swash plate;

gas passages communicating between said discharge chamber and said crank chamber for supplying said discharged compressed gas to the crank chamber from the discharge chamber; and means for controlling the flow of compressed gas through said gas passages for temporarily operating the swash plate to an inclined position when said swash plate would otherwise be caused to assume the upright position by an inner pressure of the crank chamber, whereby the oil mist is supplied to said component parts.

12. The compressor as set forth in claim 11, wherein said swash plate is temporarily forcibly inclined when the compressor is driven.

13. The compressor as set forth in claim 12, wherein said swash plate is temporarily forcibly inclined when the compressor commences to be driven.

14. The compressor as set forth in claim 11, wherein said housing includes a central hole; and wherein said compressor includes a spool accommodated in the central hole and moveable axially along a radially outer surface of the drive shaft, and a support member for supporting the swash plate, wherein the movement of the spool drives said support member to incline the swash plate.

15. The compressor as set forth in claim 14, wherein said spool has a radially outer cylindrical surface and said central hole has a radially inner cylindrical surface; and wherein said compressor includes a pressure chamber defined between said cylindrical surfaces, and a hydraulic pump is connected to the pressure chamber, said pump being arranged to be actuated by the rotation of the drive shaft.

16. The compressor as set forth in claim 15, further comprising: an oil passage extending in the drive shaft along the longitudinal axis of the drive shaft, said passage having openings communicating with the component parts, wherein said hydraulic pump supplies the oil mist to the component parts by way of the oil passage.

17. The compressor as set forth in claim 16, further comprising a valve connecting the hydraulic pump with one of the pressure chamber and the oil passage.

18. A compressor having a drive shaft rotatably supported in a housing, a swash plate mounted on said drive shaft for rotation therewith, and a piston slidably accommodated in a cylinder bore, rotation of the swash plate with said drive shaft being converted to reciprocating movement of the piston in the cylinder bore to compress gas including oil mist for lubricating sections of the compressor each section including a set of component parts in moving contact with each other, said swash plate being tiltable between an upright position normal to the drive shaft and a range of inclining positions with respect to the longitudinal axis of the drive shaft to increase displacement of the compressor, and wherein compressed gas is discharged from a discharge chamber, said compressor comprising:

a crank chamber defined in the housing and accommodating said swash plate;

gas passages communicating between said discharge chamber and said crank chamber for supplying discharged compressed gas to the crank chamber from the discharge chamber;

means for controlling the flow of compressed gas through said gas passages whereby an inner pressure of the crank chamber is varied for operating the swash plate to a range of inclined positions;

said housing including a central hole with a radially inner cylindrical surface;

a spool accommodated in said central hole and disposed for movement axially along a radially outer surface of the drive shaft, said spool having a radially outer cylindrical surface;

a pressure chamber defined between said radially outer cylindrical surface and said radially inner cylindrical surface;

a hydraulic pump connected to supply gas under pressure to said pressure chamber, said pump being actuated by rotation of the drive shaft;

a support member for supporting the swash plate, said supply of gas under pressure to said pressure chamber causing movement of the spool to engage said support member to drive said support member to operate the swash plate to an inclined position; and an oil passage extending in the drive shaft along the longitudinal axis of the drive shaft, said passage having openings for communicating with the sets of component parts, said hydraulic pump being disposed to supply the oil mist to the sets of component parts by way of the oil passage.

19. The compressor as set forth in claim 18, wherein said swash plate is temporarily forcibly inclined when the compressor is driven.

20. The compressor as set forth in claim 19, wherein said swash plate is temporarily forcibly inclined when the compressor commences to be driven.

* * * * *

UNITED STATES PATENT AND TRADEMARK OFFICE

CERTIFICATE OF CORRECTION

PATENT NO. : 5,836,748

DATED : November 17,1998

INVENTOR(S) : Masahiro Kawaguchi, et al.

It is certified that error appears in the above-identified patent and that said Letters Patent is hereby corrected as shown below:

On the title page,

In the Abstract:

Line 6, after the word "is" and before the word "supported", insert --integrally--.

Column 4, line 25, delete "to".

Column 6, line 20, change "p" to --Δp--.

Column 6, line 29, change "p" to --Δp--.

Column 8, line 29, after the word "pressure" and before the word " Δp", insert a space.

Signed and Sealed this

Twenty-ninth Day of June, 1999

*Attest:*

Q. TODD DICKINSON

*Attesting Officer*

*Acting Commissioner of Patents and Trademarks*